US006102520A

United States Patent [19]

Terasawa

[11] Patent Number: 6,102,520

[45] Date of Patent: Aug. 15, 2000

[54] RECORDING APPARATUS WITH INK SPOT VOLUME REGULATION

[75] Inventor: Koji Terasawa, Mitaka, Japan

[73] Assignee: Canon Kabushiki Kaisha, Tokyo, Japan

[21] Appl. No.: 08/375,174

[22] Filed: Jan. 18, 1995

Related U.S. Application Data

[63] Continuation of application No. 08/048,198, May 3, 1993, abandoned, which is a continuation of application No. 07/685,210, Apr. 15, 1991, abandoned.

[30] Foreign Application Priority Data

| | | | |
|---|---|---|---|
| Apr. 20, 1990 | [JP] | Japan | 2-105624 |
| Apr. 20, 1990 | [JP] | Japan | 2-105625 |
| Oct. 3, 1990 | [JP] | Japan | 2-266881 |

[51] Int. Cl.[7] ..... B41J 2/21

[52] U.S. Cl. ..... 347/43; 347/41; 347/16

[58] Field of Search ..... 347/43, 41, 5, 347/9, 16

[56] References Cited

U.S. PATENT DOCUMENTS

| | | | |
|---|---|---|---|
| 4,097,873 | 6/1978 | Martin | 347/3 |
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,516,139 | 5/1985 | Takiguchi | 347/5 X |
| 4,543,590 | 9/1985 | Tazaki | 347/43 |
| 4,549,222 | 10/1985 | Fogaroli et al. | 358/296 |
| 4,558,333 | 12/1985 | Sugitani et al. . | |
| 4,563,689 | 1/1986 | Murakami | 347/68 X |
| 4,593,295 | 6/1986 | Matsufuji et al. | 347/41 |
| 4,593,296 | 6/1986 | Dagna | 347/43 |
| 4,617,580 | 10/1986 | Miyakawa | 347/14 X |
| 4,631,548 | 12/1986 | Milbrandt | 347/15 |
| 4,639,746 | 1/1987 | Yamamoto | 347/5 |
| 4,651,175 | 3/1987 | Tazaki | 347/43 X |
| 4,672,432 | 6/1987 | Sakurada et al. | 347/43 |
| 4,682,216 | 7/1987 | Sasaki | 347/43 |
| 4,723,129 | 2/1988 | Endo et al. | 347/56 |
| 4,740,796 | 4/1988 | Endo et al. | 347/56 |
| 4,746,935 | 5/1988 | Allen | 347/15 X |
| 4,748,453 | 5/1988 | Lin | 347/43 |
| 4,750,009 | 6/1988 | Yoshimura | 347/43 |
| 4,788,563 | 11/1988 | Omo | 347/14 |
| 5,018,884 | 5/1991 | Hirano | 347/43 |
| 5,057,852 | 10/1991 | Formica | 347/43 |
| 5,075,698 | 12/1991 | Aoki | 347/43 |
| 5,220,342 | 6/1993 | Moriyama | 347/43 |
| 5,500,662 | 3/1996 | Watanabe | 347/43 |

FOREIGN PATENT DOCUMENTS

| | | | |
|---|---|---|---|
| 0348181 | 12/1989 | European Pat. Off. | B41J 3/04 |
| 54-56847 | 5/1979 | Japan | B41M 5/26 |
| 123034 | 9/1979 | Japan | B41J 3/04 |
| 58-39468 | 3/1983 | Japan | B41J 3/04 |

(List continued on next page.)

OTHER PUBLICATIONS

Eur. Pat. Off. Search Report for Eur. Pat. App. No. 91303555.6 "Method for Producing Uniform Spot Size in a Color Ink Jet Printer", IBM Techn. Discl. Bulletin, vol. 29, No. 12, May 1987.

*Primary Examiner*—Joseph W. Hartary
*Attorney, Agent, or Firm*—Fitzpatrick, Cella, Harper & Scinto

[57] ABSTRACT

A recording apparatus having a black ink recording head for discharging black ink onto a recording material and at least one single color non-black recording head for discharging non-black ink onto the recording material includes a recording head driver for driving the recording heads to discharge the ink onto the recording material and a controller for controlling the recording head driver so that a volume, per one dot area of the recording material, of the black ink discharged from the black ink recording head and deposited on the recording region of the recording material is larger than that of the non-black ink discharged from the non-black ink recording head and deposited on the recording region of the recording material.

22 Claims, 13 Drawing Sheets

FOREIGN PATENT DOCUMENTS

| | | | |
|---|---|---|---|
| 58-173669 | 10/1983 | Japan | B41J 3/04 |
| 201657 | 11/1983 | Japan | B41J 3/04 |
| 58-194541 | 11/1983 | Japan | B41J 3/00 |
| 59-123670 | 7/1984 | Japan | B41J 3/04 |
| 59-138461 | 8/1984 | Japan | B41J 3/04 |
| 190862 | 10/1984 | Japan | B41J 3/04 |
| 60-71260 | 4/1985 | Japan | B41J 3/04 |
| 60-174651 | 9/1985 | Japan | B41J 3/00 |
| 61-104856 | 5/1986 | Japan | B41J 3/04 |
| 61-230592 | 10/1986 | Japan | B41J 3/04 |
| 61-231940 | 9/1988 | Japan | B41J 3/00 |

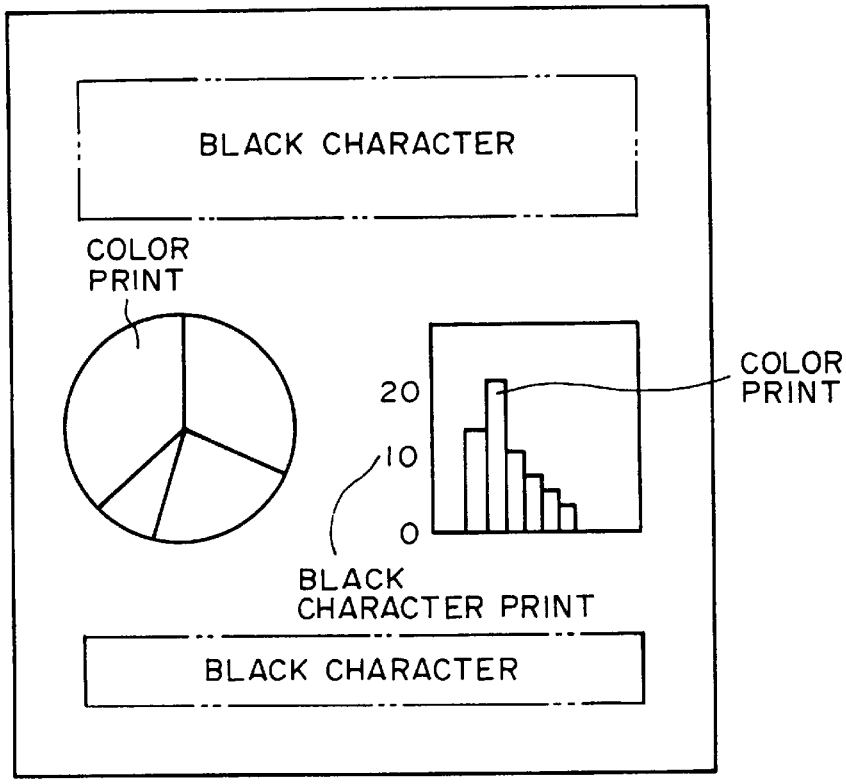
FIG. 7
FIG. 8(A)
1ST SCAN
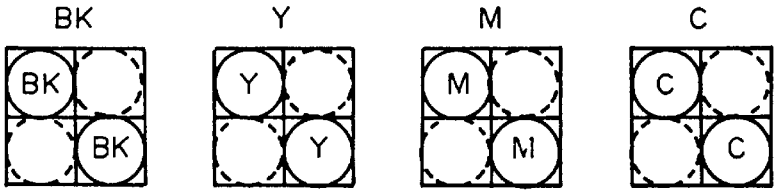
FIG. 8(B)
2ND SCAN
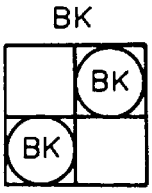

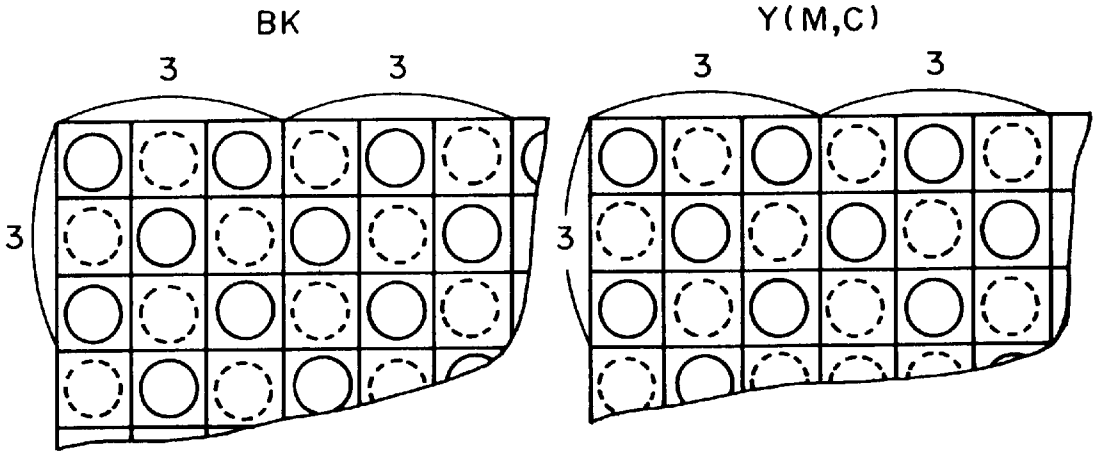
FIG. 9(A) 1ST SCAN
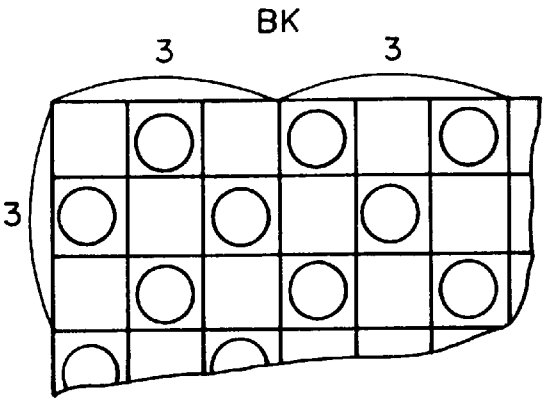
FIG. 9(B) 2ND SCAN

1ST SCAN

2ND SCAN

RECORDING APPARATUS WITH INK SPOT VOLUME REGULATION

This application is a continuation of application Ser. No. 08/048,198 filed May 3, 1993, now abandoned, which was a continuation of application Ser. No. 07/685,210 filed Apr. 15, 1991, now abandoned.

FIELD OF THE INVENTION AND RELATED ART

The present invention relates to a recording apparatus usable with office equipment or communication equipment such as a copying machine, a facsimile machine, a word processor, a personal computer or an office computer, more particularly to an ink jet recording apparatus wherein ink is discharged or ejected through an outlet to a recording medium to effect the recording.

In a color ink jet recording apparatus, one dot is printed for a monochromatic (yellow, magenta, cyan or black) picture element, whereas two dots are printed for a picture element in the case of mixed colors such as red, green or blue. A color image is formed on a recording material by the mixture of a single color dot print and a mixed color dots print.

In a conventional color ink jet recording apparatus, a particular coated sheet is used as the recording material. As long as the particular coated sheet is used, the droplet of the color ink is such as to meet the spread of the ink on the particular sheet, and therefore, the ink is properly absorbed and fixed without any problem. This is because with the particular coated sheet, the degree of the spreading is determined so as to meet the droplet discharged from the recording apparatus.

However, requiring the user to always use the particular coated sheet in a color ink jet recording apparatus, is not desirable because the coated sheet is more expensive than plain paper, because the coated sheet is more easily curled than the plain paper, because handwriting thereon is not easy and because the print is not excellent from the standpoint of durability against light. In addition, a particular one of the coated sheets are required to be used. In the recent monochromatic ink jet recording apparatus, the fixing property is significantly improved, and therefore, has been put into commercial use. In the case of the color ink jet recording apparatus, however, the fixing property of the mixed color print portion is not good because the color mixture print is provided by overlapping of the different color ink dots, and therefore, the quantity of the ink used is twice that for the monochromatic print for the same picture element.

On the other hand when, the recording material is a transparent sheet for an overhead projector (OHP) which has a relatively low ink absorption rate, or plain paper having a relatively low ink absorption rate, the spread of the ink droplet deposited on the recording material is small, with the result of a smaller dot printed. Therefore, the density of the record is relatively low. In addition, image density differences occurs between the monochromatic print (BK, Y, M or C) and a mixed color print (R, G or B). Particularly, the black print portion looks poor as compared with the other print portion.

The conventional recording apparatus of this type has been so designed to match the coated sheet having a relatively high spread rate. Therefore, the ink droplet is too small as for the recording material having the low ink absorption rate. Therefore, the density of the black print decreases.

Thus, when the color recording is carried out on the recording material having the low ink absorption rate, a monochromatic color picture element has a smaller ink spread, and therefore, has a smaller area factor with the result of the low image density.

Referring to FIG. 7, a case is shown in which black characters and color patterns such as graphs are printed in the black character print portion BP and a color print portion CP, respectively. The color print portion CP is generally recognized as pattern, and therefore, it is sufficient if the pattern can be recognized, even if the density is slightly low. However, as for the black character print portion BP, the characters have to be recognized correctly, and therefore, a sufficient print density is desired. This has not been completely accomplished in a conventional color ink jet recording apparatus.

Since a mixture of yellow, magenta and cyan colors can form black, three colors are in theory enough. However, the black color provided by the mixture of the three colors is not clear. For this reason, a color recording apparatus generally uses an separate black color. In such a color ink jet recording apparatus, monochromatic documents are printed using only the black (BK) ink.

Usually, in an ink jet recording apparatus, droplets of ink are discharged through a discharge outlet or outlets to the recording material, usually paper. Therefore, a droplet of the ink forms a circular dot on the recording material, and a character or an image is provided by gathering of such circular ink dots. The recording is carried out with the predetermined ink discharging frequency and with a predetermined scanning pitch. Therefore, even if the droplets are successively discharged, spaces are provided between adjacent dots on the recording material, if they are seen microscopically. The spaces may be a cause of the low image density, and particularly when a document is recorded with black ink, these are not desirable.

Accordingly, it is a principal object of the present invention to provide an ink jet recording method and apparatus wherein a high quality of the images can be produced on a recording material having a relatively low ink absorption rate.

It is another object of the present invention to provide an ink jet recording method and apparatus usable with a recording material having a relatively low ink absorption rate, and wherein the black print portion is not poor as compared with the color print portion, so that the high quality of the image is assured.

According to an aspect of the present invention, there is provided a recording apparatus having a black ink recording head for discharging black ink onto a recording material and at least one single color non-black recording head for discharging non-black ink onto the recording material, comprising: a recording head driver for driving the recording heads to discharge the ink onto the recording material; and a controller for controlling the recording head driver so that a volume, per one dot area of the recording material, of the black ink discharged from the black ink recording head and deposited on a recording region of the recording material is larger than that of the non-black ink discharged from the non-black ink recording head and deposited on a recording region of the recording material.

According to another aspect of the present invention, there is provided a recording apparatus having a black ink recording head for discharging black ink onto a recording material and at least one single color non-black recording head for discharging non-black ink onto the recording material, comprising: a recording head driver for driving the recording heads to discharge the ink onto the recording material; and a controller for controlling the recording head driver to operate the black ink recording head through a number of recording steps which is larger than a number of recording steps by the non-black ink recording head.

According to a further aspect of the present invention, there is provided a color ink jet recording apparatus, wherein each of the recording heads has plural ink discharging outlets; the recording heads are juxtaposed on a carriage; the plural recording heads discharge cyan, magenta, yellow and black ink materials while the carriage is scanningly moving along the recording material to effect color recording on the material, comprising: head driver for driving the recording heads to discharge the associated color ink onto the recording material; and a controller for controlling the head driver so that the number of scanning movements of the black ink recording head is larger than the number of scanning movements of any one of the cyan, magenta and yellow ink recording heads for mixed color recording.

According to a yet further aspect of the present invention, there is provided a recording apparatus, comprising: a black ink recording head for discharging black onto a recording material; at least one single color non-black recording head for discharging non-black ink onto the recording material; a recording head driver for driving both of the black ink recording head and the non-black ink recording head so that the non-black ink is present between dots of the black ink.

According to a yet further object of the present invention, there is provided a recording apparatus, comprising: a black ink recording head for discharging black into onto a recording material; at least one single color non-black recording head for discharging non-black ink onto the recording material; a recording head driver for driving both of the black ink recording head and the non-black ink recording head so that the non-black ink and the black ink are superposed, on the recording material.

According to a first embodiment of the present invention, a larger volume of black ink droplet is provided for the black ink recording area than a non-black single ink recording area, by which the black recording is sufficiently conspicuous even if the used recording material has a relatively low ink absorption rate, and therefore, a high quality print can be provided without poor black print.

According to a second embodiment of the present invention, a black color recording head for discharging black ink scans the recording material a plurality of times to provide the black print. In this case one picture element is divided into a plurality of subordinate picture elements, and the plural scans print different subordinate picture elements. In each of the scans of the recording heads for cyan, magenta and yellow colors for the purpose of color mixture recording, some subordinate dots are omitted (thinning), so that even if the recording is effected on plain paper or the like, no spread appears in the color mixture record, and the black record is clear.

According to a third embodiment of the present invention, a black ink recording head and another non-black ink recording head are both driven to record black dots so that a color ink dot such as cyan or magenta dot is provided between adjacent black dots, by which the black image density is increased by one scanning operation, so that good contrast of the record can be provided.

The recording head of the recording apparatus according to the present invention may be in the form of a replaceable recording head which is electrically connected with the main assembly of the recording apparatus and is supplied with ink therefrom when it is mounted in the main assembly, or in the form of a cartridge having an integral ink container.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 7 illustrates a black character print portion and a color print portion on a recording material.

FIGS. 8A, 8B, 9A, 9B, 10A and 10B illustrate ink dot formations in a recording apparatus according to a second embodiment of the present invention.

DESCRIPTION OF THE PREFERRED EMBODIMENTS

The preferred embodiments of the present invention will be described in detail in conjunction with the accompanying drawings.

Figure 1:
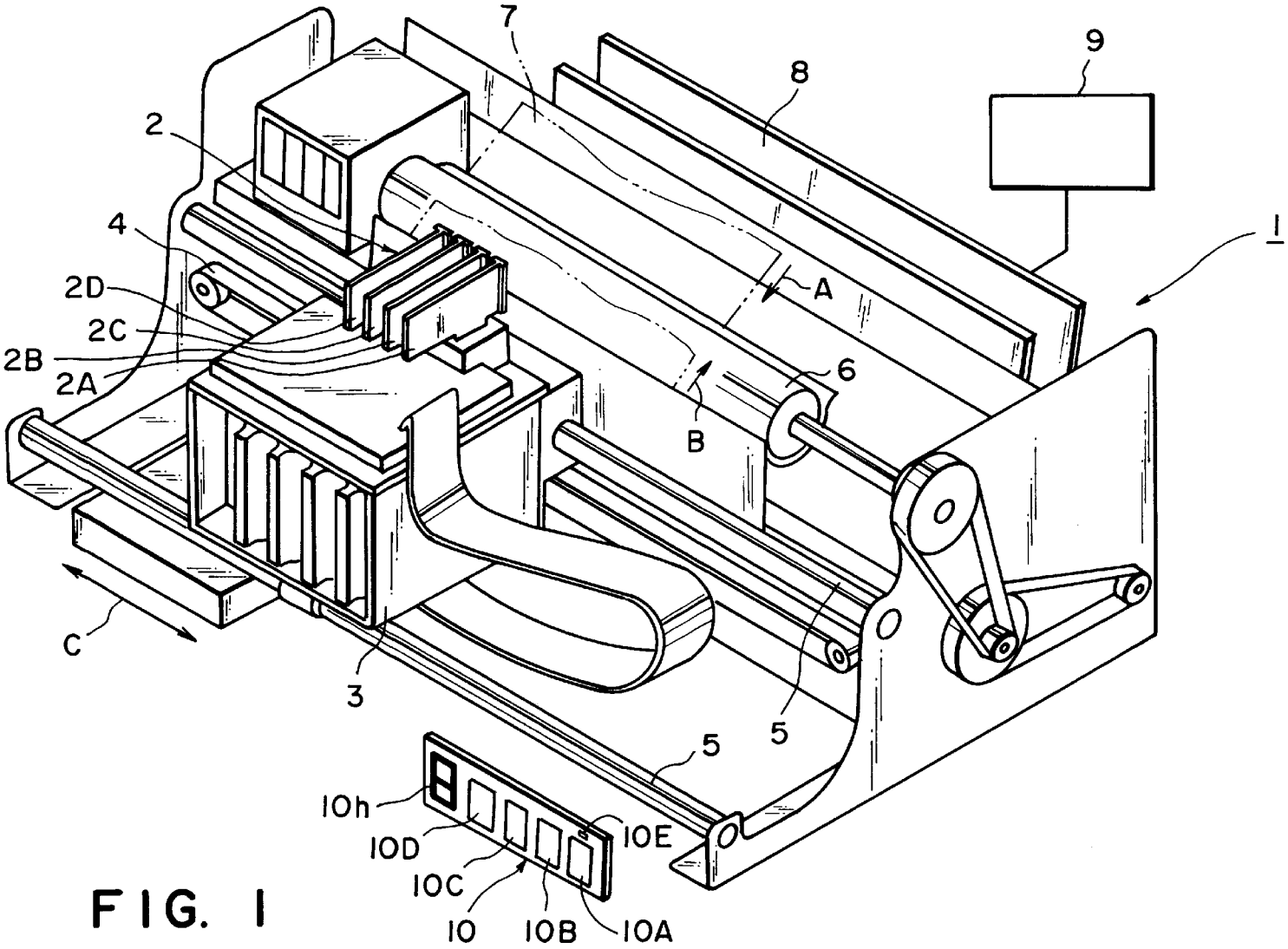
FIG. 1 is a perspective view of a recording apparatus according to an embodiment of the present invention.

Referring to FIG. 1, there is shown a main assembly of a recording apparatus according to the present invention. The main assembly 1 of the recording apparatus is loaded with a color image forming recording head unit comprising a black (BK) recording head 2A, a cyan (C) recording head 2B, a magenta (M) recording head 2C and a yellow (Y)

recording head 2D, which are arranged in a line along a scanning direction of the recording head unit. The recording head unit 2 is mounted on a carriage 3 of the main assembly 1.

That surface of each of the recording heads 2A, 2B, 2C and 2D which faces recording material 7 is provided with a plurality of ink ejection (discharging) outlets arranged vertically in the Figure at predetermined intervals. Corresponding to the ink ejection outlets, there are provided electrothermal transducers (heat generating resistors), which are driven in accordance with the information to be recorded. The driving of the heat generating resistor produces a bubble in the ink, by which pressure is produced sufficient to eject the ink droplet to the recording material. Therefore, a pattern is provided by the dots formed with the ejected ink droplets. Each of the recording heads has a circuit board including heater drivers for driving the electrothermal transducers.

A controller is formed on a control board 8 and includes a control circuit (CPU) for the recording apparatus, ROM and RAM or the like in connection with the control circuit. The controller receives instruction signals and data signals (record information) from a host apparatus 9 such as a computer. In response to the received signals, the controller energizes driving sources such as motors and applies a driving voltage (heating voltage) to the electrothermal transducers of the recording heads 2A–2D through the heater drivers.

The carriage 3 is connected with a belt 4 and is reciprocated in a direction of an arrow C along a guide shaft 5 by a motor (not shown). A platen 6 guides the recording material to a recording position, maintains it at the correct position, feeds the recording material and further, discharges the recording material in the direction of an arrow B after the recording operation. Here, the recording material may be the usual coated sheet, or a transparent film for an overhead projector (OHP).

Designated by a reference numeral 10 is an operation panel on an outer casing of the recording apparatus. It includes a switching key 10A for switching between on-line state and off-line state, a line feed key 10B, a form feed key 10C, a recording mode switching key 10D or the like in the setting key area. It also includes a display area including some alarming lamps, a power source lamp or another warning lamp 10E and a 7 segment digit display 10H.

Figure 2:
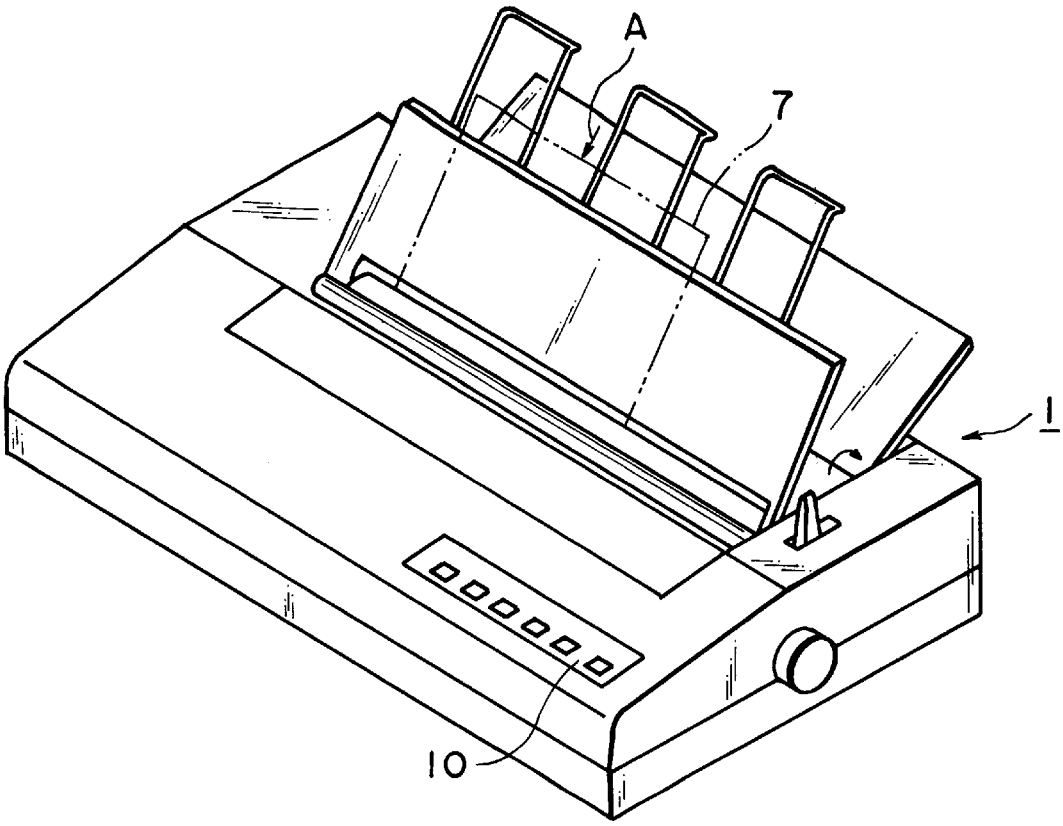
FIG. 2 is a perspective view of the recording apparatus with an outer casing.

FIG. 2 shows an outer appearance in a perspective view of the main assembly 1 of the recording apparatus provided with an outer casing and supplied with a recording material in the form of a recording sheet.

When color recording is performed on a recording material 7, the image density and the quality of the images produced on the recording material 7 is different if the ink (liquid) spreading nature of the recording material 7 is different. In view of this, the apparatus of this embodiment is operable in a mode suitable for use with a recording material 7 such as an OHP film, which has a lower ink absorbing nature, and a mode suitable for use with coated paper or the like which has a high ink absorbing nature.

The selection of the modes is effected by a printer command of the host apparatus 9 or operating a selector switch or the like on the operation panel 10. On the basis of the selection of the mode, the ink ejection is controlled in accordance with the nature of the recording material.

Figure 3:
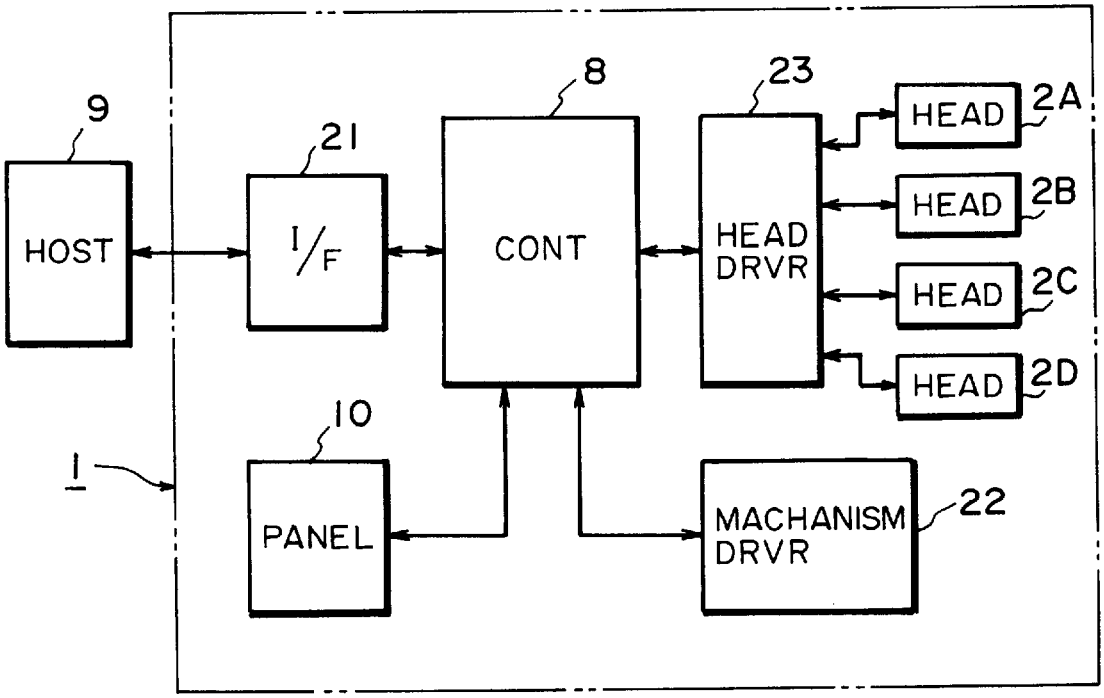
FIG. 3 is a block diagram of a control system for the recording apparatus according to the present invention.
Figure 4A:
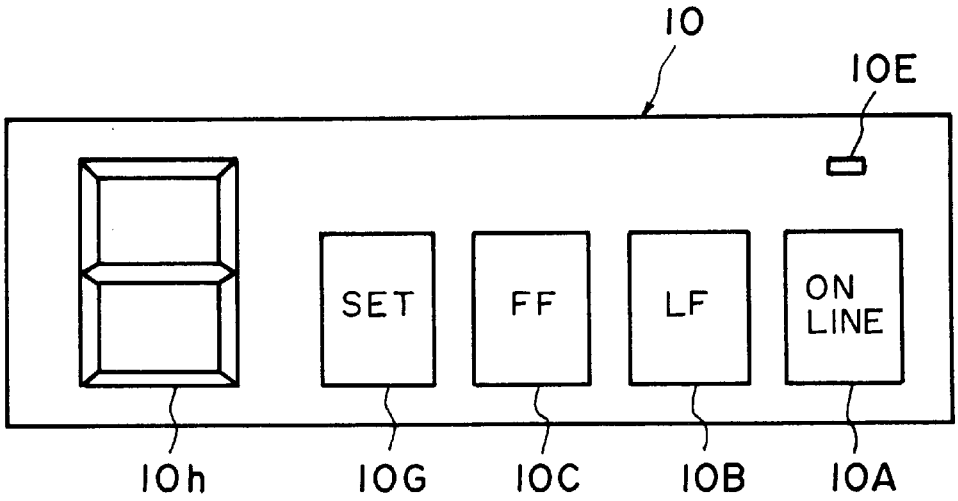
FIGS. 4A and 4B are top plan views of operational panels.
Figure 4B:
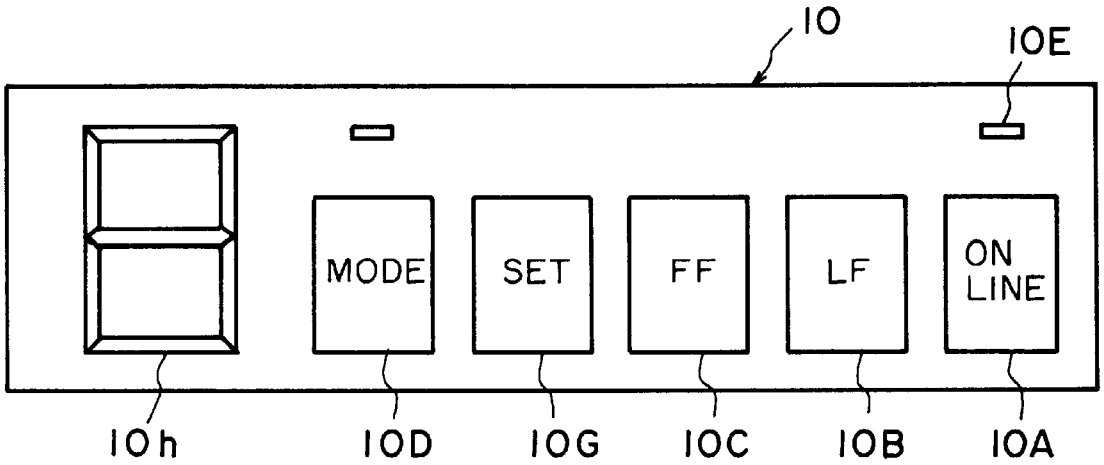

FIGS. 3, 4A and 4B show the structure of the circuit for performing the above operation in the recording apparatus, and examples of switches on panels 10 for selecting the modes described above. The circuit of FIG. 3 comprises an interface 21 with the host apparatus 9, a driving system 22 disposed between the driving system and the carriage 3 or the platen 6 or the like, and a head driving system 23 for controlling the driving of each of the recording heads 2A–2D through a controller 8 in accordance with the selected mode. As shown in FIGS. 4A and 4B, the operation panel has an on-line switch 10A, a setting switch 10G for setting in the memory of the controller 8, a mode selector switch 10D for selecting a mode. The mode can be selected by a combination of operations which will be described hereinafter. Of course, it is possible to set a command therefor.

When the command from the host apparatus 9 is directly used, the on-line switch 10A shown in FIG. 4A or 4B takes the on-position. If the panel 10 actuation is used, a coated sheet mode is selected by, for example, deactuating the on-line switch 10A, actuating the setting switch 10G, and then actuating the line feed switch 10B. In the coated sheet mode, one shot is given to the single color Y, M and C dot and also for black dot (black character). In the case of the panel shown in FIG. 4B, the on-line switch 10A is deactuated, and the mode selector switch 10D is actuated, and thereafter the setting switch 10G is actuated n-times to change the display of the 7 segment digit display 10H when the changed display is a predetermined numeral, the above-described coated sheet mode is set, and then, the mode selector switch 10D is actuated again, by which the mode is selected. This is an example. The display of the mode is not limited to the numeral, but may be a character or characters using a display constituted by a liquid crystal display having a number of dot matrix liquid crystal segments.

When a black stressing mode is to be selected with the use of plain paper having a low ink absorbing nature, the mode is selected in the panel 10 of FIG. 4A, for example, by deactuating the on-line switch 10A, actuating the setting switch 10G a plurality of times, and further actuating the line feed switch 10B.

In the case of the panel 10 of FIG. 4B, similarly to the selecting of the coated sheet mode, the on-line switch 10A is deactuated, and the mode selector switch 10D is actuated, and thereafter the setting switch 10G is actuated m times, by which the display on the digit display 10H is made the numeral representing the black stressing mode, and then, the mode switch 10D is actuated again.

In the recording apparatus according to the first embodiment, when a black character or characters or a black line or lines are to be printed, the proper mode is selected, and the double printing is effected in response to character codes supplied from the host apparatus 9, by which the print density of the black character print portion BP is enhanced.

Figure 5A:
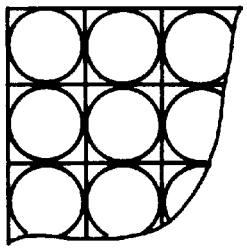
FIG. 5A illustrates dot formations in a single color print in a recording apparatus according to a first embodiment of the present invention.
Figure 5B:
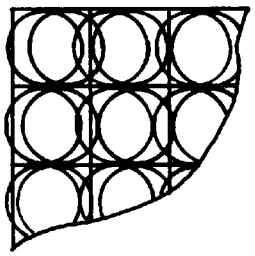
FIG. 5B illustrates dot formations of a color mixture print portion and a black character print portion in the first embodiment.

The ink jet recording apparatus constructed in the manner described above is operable in the coated paper mode and in the black stressing mode. In the coated paper mode, it provides superposing shots in the image or characters in a mixed color, R, G or B, whereas it provides one shot in a black character or the like, similarly to the other single color (Y, M or C) images or characters. In the black stressing mode, the recording apparatus provides a color superposing or double shots, as shown in FIG. 5B in the mixed color record and in the black character, respectively, whereas it provides one shot for each picture element, as shown in FIG. 5A, in the record of monochromatic color (Y, M or C). By doing so, the record density can be enhanced for a black characters or letters or black frames or the like even when using OHP film or another recording material having a low ink absorbing nature, and therefore, a high quality of the image can be provided. It is preferable that the volume of the black ink for the black character per one shot is larger than a total volume of the ink for the mixed color record per one shot. As regards the yellow, magenta and cyan colors, the recording is effected with single shot, and therefore, the ink materials for these colors are not wastefully consumed. The double or superposing ink shots may be effected during one scan, but may be effected in two scans.

In the foregoing description of the embodiment, the ink is superposedly shot, but it is a possible alternative that the second shot may be effected with a deviation of a half pitch of the minimum resolution picture element. This can be accomplished by hardware or software.

As for the output of CAD, the density of a line image is desirably high. In this case, it is preferable to provide a CAD output mode. Then, the operator can make selection from one dot recording and double dots recording for a line image recording. The CAD output mode can be selected in the similar manner as in the coated paper mode selecting in a panel 10 of FIG. 4B. The plain paper mode and the OHP film mode may be selected in the similar manner.

Figure 6:
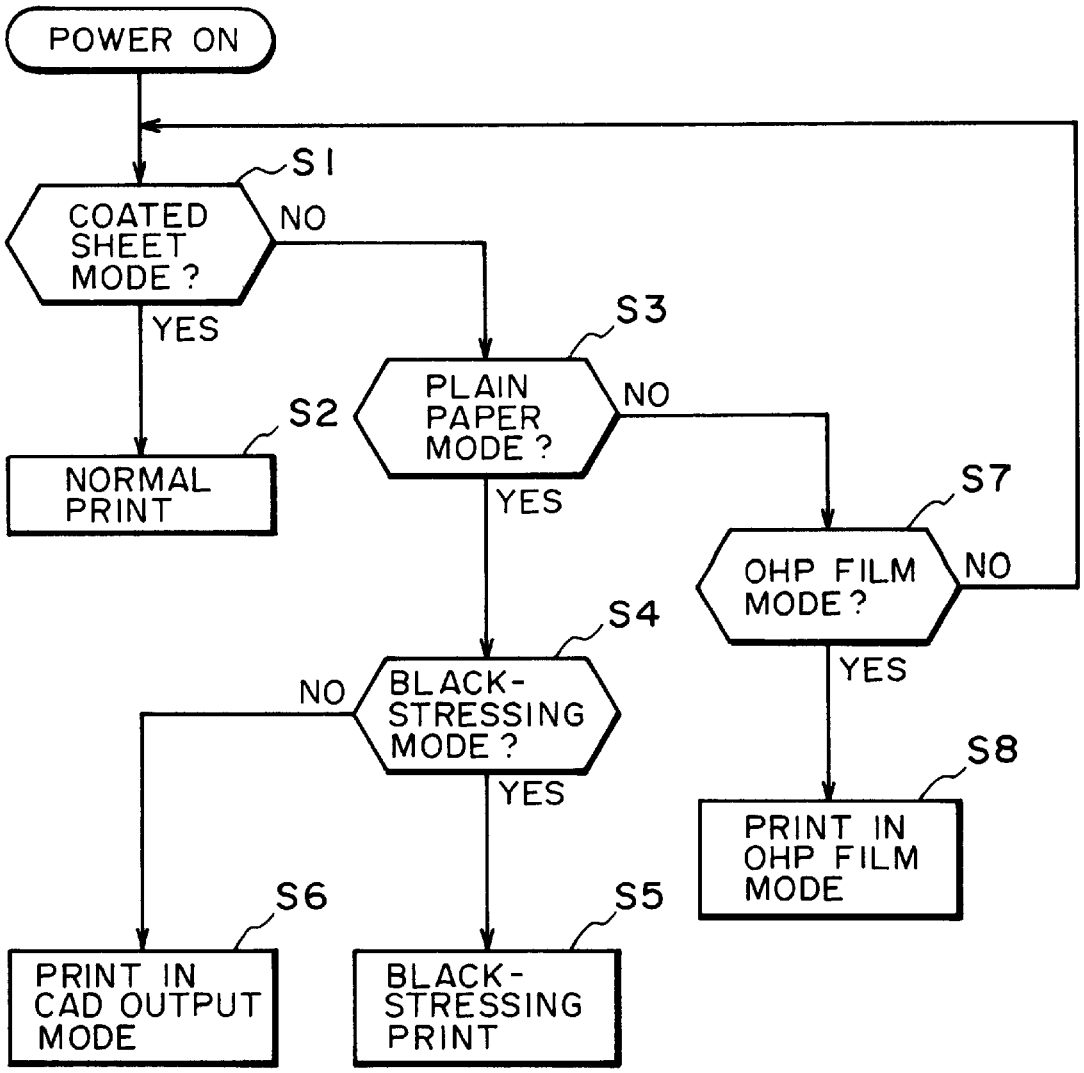
FIG. 6 is a flow chart illustrating sequential recording operations for setting the operational mode in the first embodiment.

FIG. 6 shows the process of selecting a mode from the above-described modes. When the main switch is actuated, and the mode is selected by a command from the host apparatus 9 or by the operator in the panel 10, the controller 8 discriminates as to whether or not the mode is the coated paper mode, at step S1. If so, the operation proceeds to step S2, by which the conventional routine is carried out in which one shot is provided for cyan, magenta, yellow or black color, and superposing (two) shots are effected for a mixed color such as red, green and blue. If the result of discrimination at step S1 is negative, the operation proceeds to step S3, wherein the discrimination is made as to whether or not the selected mode is the plain paper mode or not.

If so, the operation proceeds to step S4 wherein the discrimination is made as to whether or not the mode is the black stressing mode or not. If so, step S5 is executed wherein the black stressing mode operation is carried out so that the double shots are carried out for black characters or the like. If the result of discrimination at step S4 is negative, the operation proceeds to step S6 where the CAD outputting mode operation is carried out so that the black double shots are provided only for the black line images. If the result of discrimination at step S3 is negative, the operation proceeds to step S7 in which the discrimination is further made as to whether or not the selected mode is the OHP film mode. If not, the absence of used mode is finally discriminated, and the operation returns to step S1. If so, the operation proceeds to step S8 where the OHP film mode shooting carried out for the color print.

The driving means for the recording head is controlled by the control means so that the volume of the black ink per one dot area discharged from the black ink recording head and deposited on the recording region of the recording medium is larger than the volume of the single color non-black ink discharged from the non-black recording head and deposited on the recording region of the recording material. Therefore, the resultant record is as shown in FIGS. 5A and 5B. More particularly, the average volume of the ink deposited on one pixel location to receive the ink is controlled in the manner described above. Here, the pixel locations are points on the recording material that may be chosen as locations where droplets of ink are to be deposited to form dots upon drying. The pixels are usually visualized as lying on the nodes of a raster of regularly arranged points in two dimensions. In the foregoing description, the recording methods are different for the black ink recording head and the non-black ink recording head. However, it is a possible alternative that a non-black ink recording head and a mixed color recording head are combined so that the volume of a single color ink per unit area discharged from the single color ink recording head and deposited on the recording region of the recording material is not less than the volume of the mixed color ink per unit area discharged from the mixed color recording head and deposited on the recording region of the recording material as a mixed color dot. A further alternative is that the volume of the ink per one dot area discharged from the recording head and deposited on the character region or a line image region of the recording material is larger than the volume of the ink per unit area deposited on the recording region of the recording material other than the character or line image region.

As described in the foregoing, according to the first embodiment of the present invention, when an OHP film or plain paper or the like which has a low ink absorbing nature is used as the recording material, the volume of the ink shot to the black character, letter or line image or the like is made larger than the volume of the shot non-black ink, by which the non-black print regions have suppressed ink to permit easy pattern recognition, whereas the characters or the like have high image density to permit better reading. As a result, the print quality can be enhanced corresponding to the natures of the recording materials.

What is important in the color recording on plain paper is, in the case of the record image as shown in FIG. 7, for example, that the black character print BP and the black frames are sharp and clear, whereas the other color print portion CP is only required to be clear in the color recognition. If they are satisfied, sufficiently high quality documents may be provided.

However, as described hereinbefore, in the color mixed portions such as red, green and blue portions, the volume of the shot ink is 200% due to the superposition of the different color shots. In this case, the plain paper is not able to absorb the with sufficient speed. This applies to the case wherein the plural shots are given for the purpose of enhancing black. Then, the record is unsharp or the print surface is contaminated.

The second embodiment of the present invention which will be described hereinafter, is particularly directed to this problem. Briefly, this embodiment is such that for the print portion of black characters or the like, the dots are printed for all of the picture elements (unit dot) constituting a datum on the basis of dot data in order to advantageously use the fine line recording capability provided by the precision ink ejection outlets of the recording apparatus, whereas for red, green, blue and mixed color print portions, only partial dot or dots are printed so as to promote ink absorption provided adjacent to the partial printed dots.

FIG. 8 shows the printed dots in the second embodiment of the present invention. In this example, a unit datum is divided into or converted to a plurality of picture elements (2×2), and the recording is effected on the basis of the data. The broken line and solid line circles represent the regions where the data are to be present. The solid line circle represents the dot actually shot by the ink in this example. By a first scan by the recording heads 2A–2D, black, yellow, magenta and cyan ink dots are shot at a pair of diagonally opposite positions of the divided picture elements. For the mixed colors, red, green and blue, they are provided by superposition of yellow, magenta and cyan, and therefore, the superposing shots are given to the same positions during the first scan. However, the other pair of diagonally opposite positions including the broken line circles are free from dots, and therefore remain as spaces functioning to absorb the ink. Therefore, the ink is easily fixed.

In the second scan, as shown in FIG. 8B, only black ink dots are shot at the opposite diagonal positions. Therefore, in the black print portions, the dots are shot for all of the picture elements forming the datum as a solid dot. Thus, the black print can be made conspicuous. In addition, in this example, the black ink shot during the first scan is absorbed until the second scan, so that the black record is fixed better. Furthermore, the density of the mixed color record (R, G or B) is sufficiently high with the stabilized fixing property. In the second scan, only the black ink dots may be shot superposedly to the same positions as in FIG. 8A. Even in this case, the ink absorbing spaces are provided at the other diagonal positions, so that the fixing property is improved with the enhanced black record.

FIG. 9 shows an example wherein a unit datum is divided into or converted to 3×3 picture elements. In this example, the first scan shoots the ink dots to the divided dots of solid lines for black, yellow, magenta and cyan colors, as shown in FIG. 9A. In the second scan, only black ink is shot to the divided picture elements of broken lines. According to this example, the black color can be stressed, and the ink absorbing spaces are provided for the red, green and blue dots to be provided by superposing yellow, magenta and cyan colors, and therefore, the image fixing property can be improved.

Figure 10A:
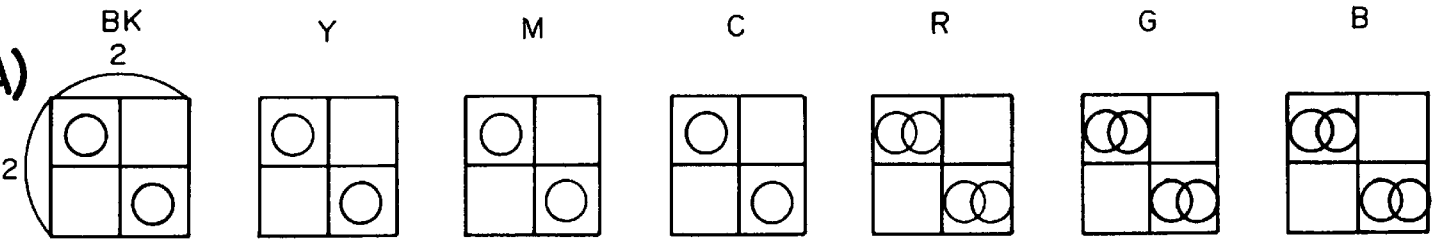
Figure 10B:
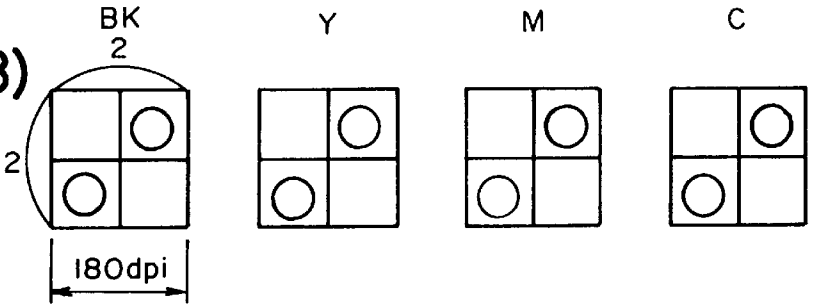

FIG. 10 shows a further example of recording dots. In this example, one dot pattern datum for the respective ink materials is determined for the plain paper mode selected. A datum is converted and is formed as n×n (2×2 in this example) picture elements are provided in the form of a matrix. The 100% shooting is effected for each of the colors relative to the minimum resolution of the recording head, and still, the record fixing property is improved.

In this embodiment, the color recording is effected with the picture element density of 180 dpi, while the minimum resolution is 360 dpi. In the first scan, as shown in FIG. 10A, the ink dots are shot at one of the diagonal positions for a single color (Y, M, C or BK) record. As for the color mixed record (R, G or B), the colors are superposed on the basis of the divided dot data for yellow, magenta and cyan. The second scan shoots the ink dots at the other diagonal positions for black, yellow, magenta and cyan. The ink is absorbed by the recording material after the completion of the first scan and before the start of the second scan. Therefore, the ink is fixed in good order for the black, yellow, magenta and cyan colors. As for the color mixed dots (red, green or blue) provided by the mixture of the yellow, magenta and cyan color, the ink is absorbed by the spaces therearound, and therefore, the ink is fixed again in good order. The conversion of the binary datum to the 2×2 matrix may be made using a gage array LSI (GA) or the like of the controller.

In the foregoing description, the number of scans for the black color record by the black ink recording head is larger than the number of scans for the mixed color recording by the cyan, magenta or yellow ink recording head. However, this is not limiting, and it is a possible alternative that the number of scans for a single color recording by the single color recording head is larger than the number of scans for the mixed color recording by a mixed color recording head for ejecting each of color ink other than the single colors. It is a further alternative that the number of scans for the character or line image recording is larger than the number of scans for the recording other than the characters or the line images.

As described in the foregoing, according to the second embodiment, the number of scans for the black recording is larger than the number of scans for the mixed color recording, by which the black color is made conspicuous, and in addition, the ink dots are formed at different positions in the scans, so that the ink is more easily fixed. In the color record portion other than the black record portion, the pattern thereof can be sufficiently recognized. Where the recording is effected with yellow, magenta, cyan and black recording heads, the black recording head scans continuously, and therefore, the two scans can be carried out with one reciprocation, by which the recording throughput is better.

Figure 11:
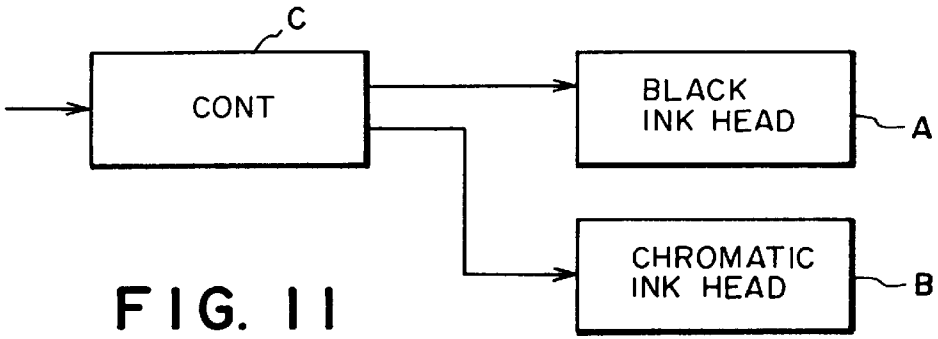
FIG. 11 is a block diagram of a control system of the apparatus according to the third embodiment.

FIG. 11 shows a third embodiment which is also directed to an ink jet recording apparatus for effecting color recording using plural color ink materials. A black ink recording head A ejects or discharges black ink through its ejection outlets to the recording material. The recording apparatus comprises color ink recording head for ejecting non-black ink through its ejection outlet. Control means C drives both of the black color recording head A and the non-black color recording head B so that the non-black or chromatic color ink is shot between black dots. In this embodiment, the non-black ink is either cyan or magenta ink material. The control means C controls the ejection timing so that the non-black ink is shot between adjacent black dots by deviating the ejection timing by approximately ½ dot, for example. The control means C may control the ejection timing so that the non-black ink is shot superposedly on the black dot. In addition, the control means C may provide a smaller amount of non-black ink than the black dot.

Figure 12:
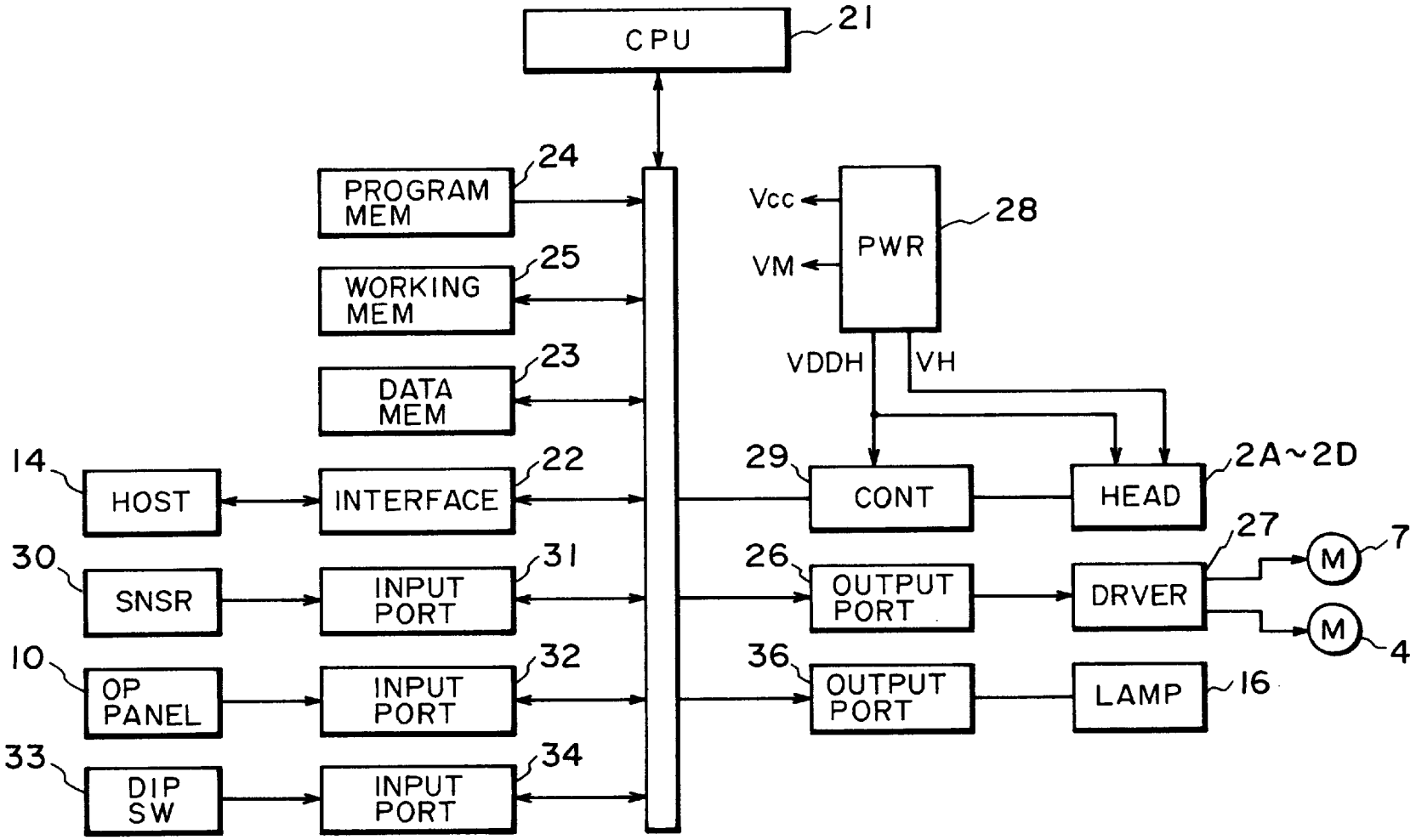
FIG. 12 is a block diagram of a recording system of the recording apparatus according to the third embodiment.
Figure 13:
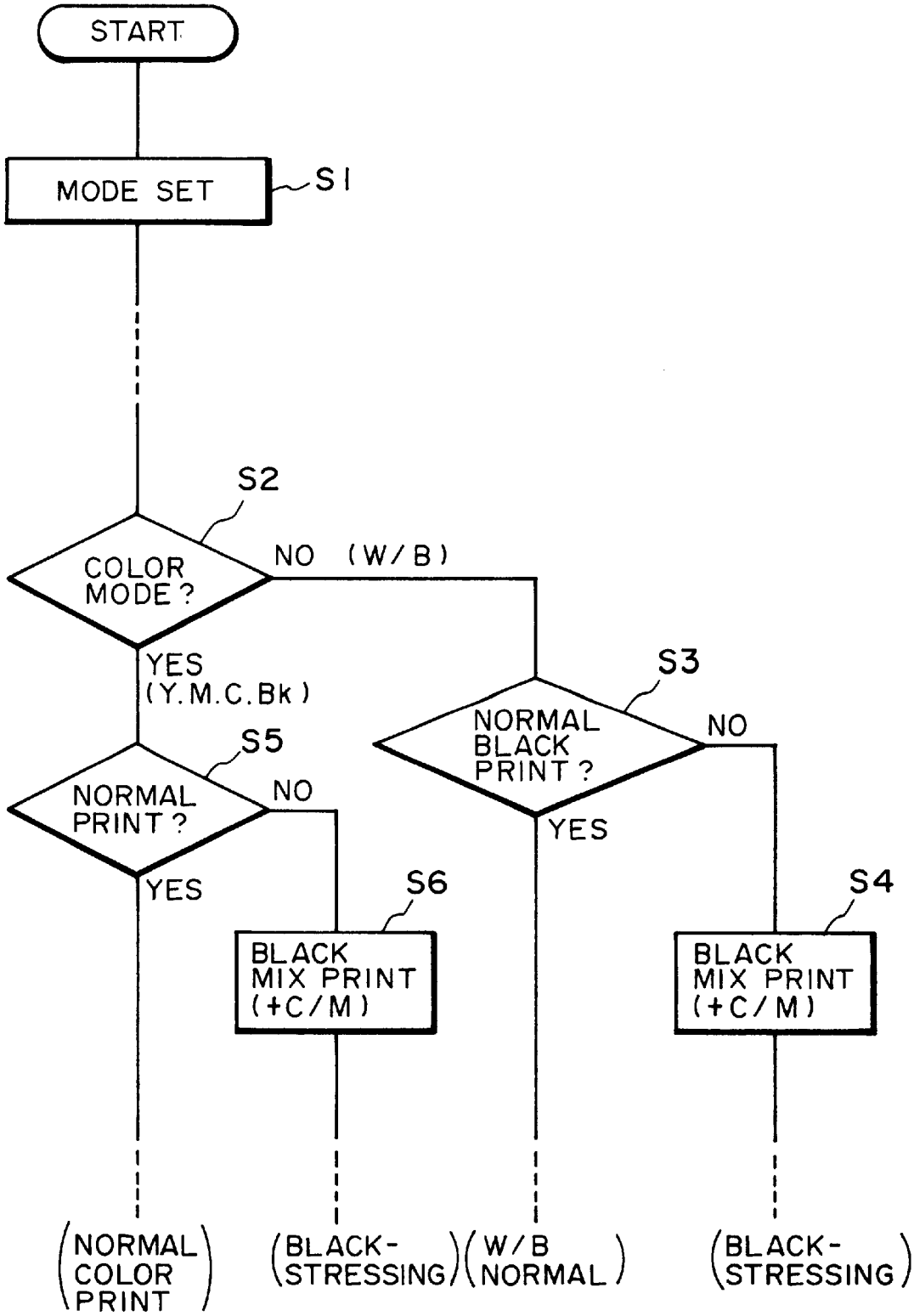
FIG. 13 is a flow chart illustrating the sequential operations for setting an operational mode in the third embodiment.

FIG. 12 is a block diagram of a control system of the recording apparatus according to a third embodiment of the present invention. In FIG. 12, the central processing unit (CPU) 21 in the form of a microprocessor is connected with a host apparatus 14 such as a computer through an interface 22. It controls the recording operation in accordance with commands read from the host apparatus 14 into data memory 23, record information signal and in accordance with the program or data, as shown in FIG. 13, stored in program memory 24 in the form of a ROM or working memory 25 or the like.

A sheet sensor 30 detects whether or not the recording material 1 is present in the recording apparatus, and the detection signal is supplied to the CPU 21 through an input port 31.

The outputs from the operation keys 10A–10D or the like on the operation panel 10 having the same structures as described with the foregoing embodiments, are supplied to the CPU 21 through the input port 32. An alarming lamp or power source lamp 16 or the like, receives control signals from an output port 36.

Dip switches 33 are provided at the bottom of the outer casing, and the outputs thereof are transmitted to the CPU 21 through an input port 34.

Power source circuit 28 produces a logic drive voltage Vcc (5 V) for driving control logic circuits, various motor driving voltages VM (30 V), a heater voltage (head voltage) VH (25 V) for heating the dot forming elements (electrothermal transducers) of each of the recording heads, and a back-up voltage VDDH or the like for protecting the recording heads 2A–2D. The heating voltage VH is directly supplied to the recording heads 2A–2D, and the back-up voltage VDDH is supplied to a head control circuit 29 and the recording head 2A–2D.

Figure 14:
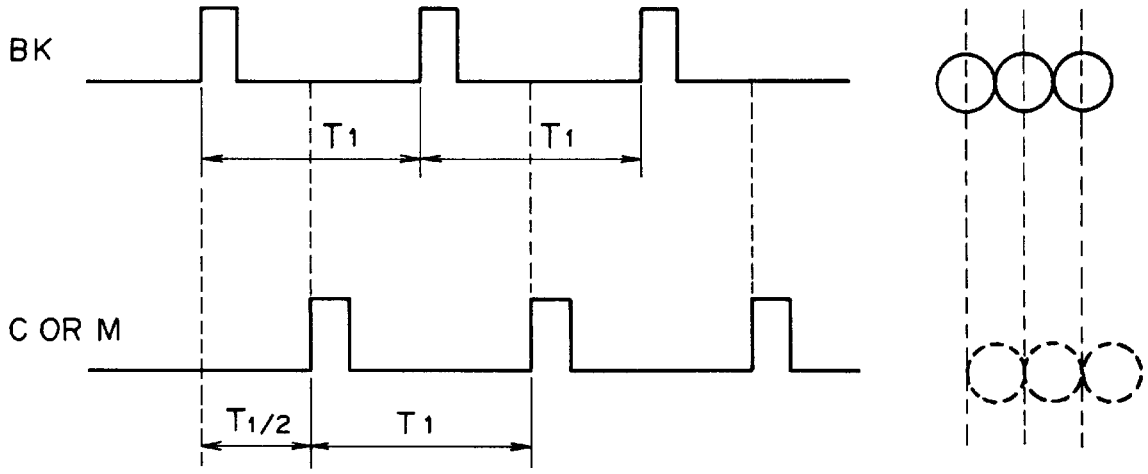
FIG. 14 is a timing chart of an example of a head driving pulse in a black mixture recording in the recording apparatus according to the third embodiment.
Figure 15:
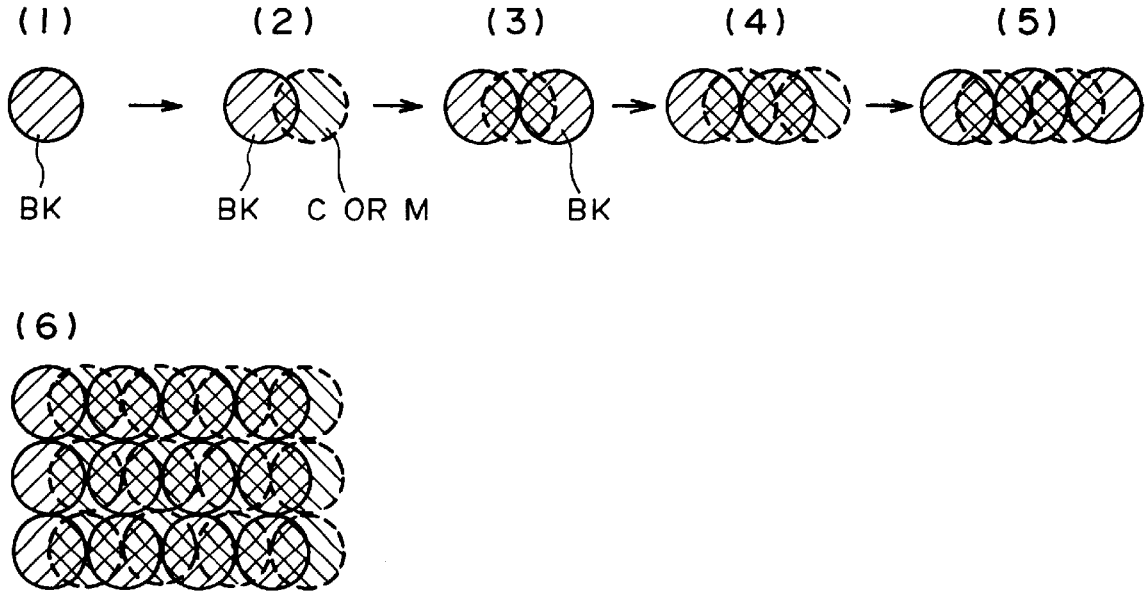
FIGS. 15 and 16A and B are enlarged views of the dot record provided by the recording apparatus according to the third embodiment.

Referring to FIGS. 13, 14, 15 and 16, an example of operations of the color ink jet recording apparatus according to this embodiment will be described. FIG. 13 is a flow chart illustrating an example of the record processing step; FIG. 14 is an example of a timing chart of head driving pulses during a black mixture recording operation which will be described hereinafter; and FIGS. 15 and 16 illustrate the record on a recording material in an enlarged view.

As shown in FIG. 13, a recording mode is selected at step S1 to be a color mode, a normal black printing mode or a normal printing mode. The selection of the recording mode may be accomplished in the same manner as in the first embodiment, more particularly, using the panel 10 as shown in FIG. 4B, for example to select the coated sheet mode. Otherwise, the selection may be made on the basis of a command from the host apparatus 14.

Thereafter, the discrimination is made as to whether the recording mode or the color mode is selected, at step S2. If it is not the color mode, that is, if black and white mode is selected, the discrimination is further made as to whether or not the normal black printing mode is selected, at step S3. If it is the normal black printing mode, the usual black and white recording is carried out using only the black ink (BK), similarly to conventional recording machines. If it is not the normal black printing mode, the black mix recording process according to this embodiment is carried out, at step S4.

In the black mix recording, as shown in FIG. 14, for example, not only the black ink but also the cyan ink or magenta ink is used. In the example of FIG. 14, the cyan or magenta ink recording head 2B or 2C is supplied with a driving pulse having the same waveform as the black recording but at a timing deviated by ½ dot (½ pulse) from the black ink ejection timing. The deviation of the ejection timing may be accomplished by the software delay using a proper buffer memory or counter or the like.

Therefore, the record provided by this process is, as shown in FIG. 15, cyan or magenta ink droplet (broken line) is shot at a position ½ dot deviated from the black ink droplet (solid lines). Therefore, as shown in FIG. 15, (6), the small spaces (white) between adjacent black ink dots are filled with cyan or magenta ink droplets, substantially completely, so that the spaces disappear. With this aid of the spread of the ink, the space is considered to be completely removed. By this, the recording density is improved, so that the high quality recording can be provided which is not provided by the usual recording. This process can be completed by a single recording scanning operation, and therefore, the high speed recording as in the usual recording mode is accomplished. The spaces have a size which is relatively smaller as compared with the size of the ink dots, and in addition, black ink is superposed with another color ink, and therefore, the change of the color attributable to the use of the cyan or magenta ink is not practically seen. Considering the fact that black ink which is actually slightly blue is widely used with fountain pens or printing devices, the above-described mixed black color is practically of no problem. As will be understood from the foregoing, according to this embodiment, the cyan or magenta ink droplets are shot not to the space resulting between adjacent black dots from improper black ink recording head ejection or the like, but to the spaces between adjacent black dots which are necessarily provided by correct ejection operations of the black ink recording head. By doing so, the spaces are removed to improve the record density. In the case of the recording apparatus wherein the cyan or magenta ink shots precede the black ink shots, the cyan or magenta shots may be carried out at the proper positions before the black droplets are shot. In the examples of FIGS. 14 and 15, one cyan or magenta dot is provided for one black dot. It is a possible alternatively that one cyan or magenta dot is provided for two black dots, for example, thus a smaller number of non-black dots are provided than the number of black dots. By reducing the number of non-black dots, the resultant color is closer to pure black. This reduced shot can be accomplished by, for example, skipping reading the recording data from the buffer for every other dot for the non-black shots. This is advantageous when the sharpness of the image is particularly desired or when the recording paper is the plain paper having a major of easier ink spread.

Figures 16A, 16B:
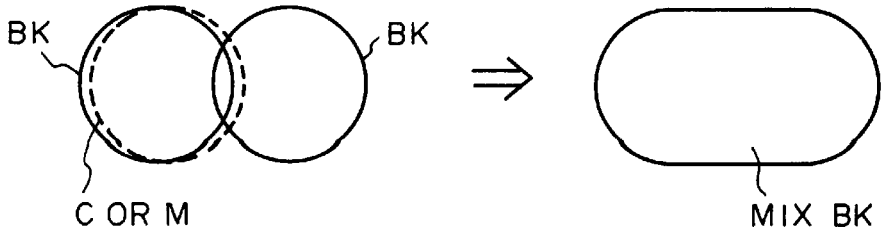

As shown in FIG. 16, the cyan or magenta ink may be ejected in the matched timing with the black ink ejection. By doing so, the density of the black recording can be improved. By depositing the shot of the cyan or magenta ink substantially on the black dot, as shown in FIG. 16A, the ink droplets are mixed, as shown in FIG. 16B, and the mixture spread toward the adjacent black dots, so that the small spaces disappear. In this case, one cyan or magenta dot is shot for two black dots.

The black mixture recording is effective also in the color mode. Referring back to FIG. 13, if the color mode is discriminated at step S2, and if the normal recording is discriminated at step S5, the conventional color recording is executed. If it is not the normal recording, the black mixture recording process is carried out at step S6, wherein the black color is stressed. The black mixture recording process is similar to the black mixture recording process at step S4 described hereinbefore. In addition to the normal color recording operation, the black mixture recording operation described with the step S4 is executed. For example, if the cyan color ink is used for the black mixture recording, the cyan ink dot is used both for the color image production and for the black stressing. This can be accomplished by using a driving signal which is a combination of a cyan drive signal for the normal color recording and a cyan signal for the black stressing, as shown in FIG. 14. As will be understood, the black mixture recording process in the color mode is effective to increase the density of the black record, and therefore, the black line or black frames are stressed to provide clear and high contrast color image. This is particularly preferable in the case where a color picture and sentences are mixed on a single page.

In the foregoing description, the black ink recording head and a chromatic color ink recording head are both driven to shoot the chromatic color ink at the position between adjacent black dots, or the chromatic color ink is shot one of the adjacent black dots. However, it is a possible alternative that a first color ink recording head and a second color ink recording head are both driven to shoot the second color ink between the first color ink dots, or that the second color ink is shot at the position superposing one of the adjacent first color ink dots. It is a further alternative that the deposition of the second color ink is effected only for a character or the like record or to a line image.

As described in the foregoing, according to the third embodiment of the present invention, the black ink recording head and the non-black ink recording head are driven to shoot the non-black ink between black dots, and therefore, the black record density is enhanced by one recording scan without decreasing the ejection frequency and without decreasing the recording speed. Therefore, the print quality is improved.

The present invention is particularly suitably usable in an ink jet recording head and recording apparatus wherein thermal energy by an electrothermal transducer, laser beam or the like is used to cause a change of state of the ink in order to eject or discharge the ink. This is because the high density of the picture elements and the high resolution of the recording are possible.

The typical structure and the operational principles are preferably the ones disclosed in U.S. Pat. Nos. 4,723,129 and 4,740,796. The principles and structure are applicable to a so-called on-demand type recording system and a continuous type recording system. Particularly, however, it is suitable for the on-demand type because the principles are such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the abovementioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head made from plural recording heads combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of a recovery means and/or the auxiliary means for the preliminary operation are preferable, because they can further stabilize the effects of the present invention. As for such means, there are known capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the different recording heads that can be used, they may be a single head corresponding to a single color ink, or may be plural heads corresponding to the plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is the present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet faces to the electrothermal transducers. The most effective one of the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

Figure 17:
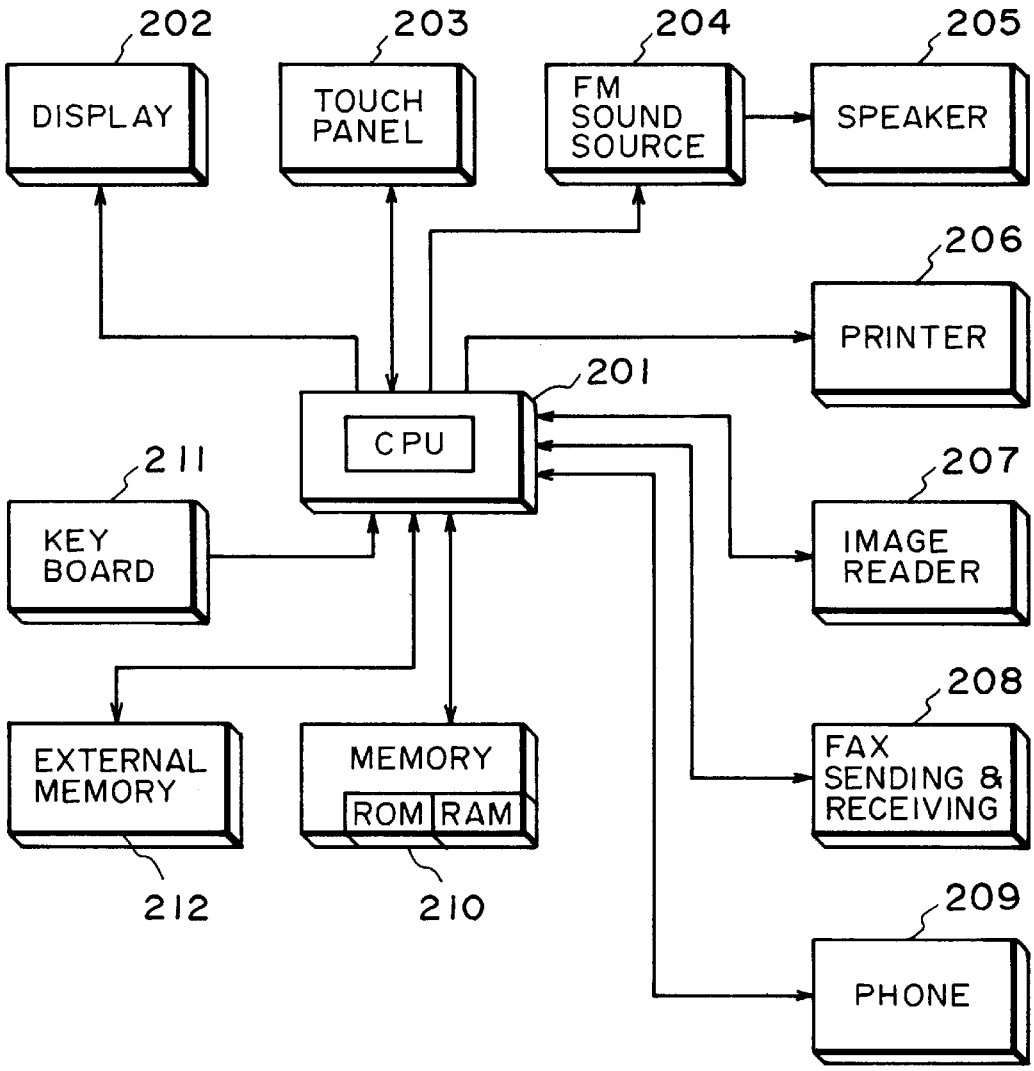
FIG. 17 is a block diagram of a system when the recording apparatus according to the present invention is used in an information processing apparatus.

FIG. 17 is a block diagram of a system of the recording apparatus of this invention wherein it is applied to an information processing apparatus having a function of a wordprocessor, a personal computer, facsimile machine and copying machine.

A controller 201 controls the entirety of the apparatus and is provided with CPU in the form of a microprocessor or the like and various I/O ports to supply control signals, data signals and the like to various parts and to receive control signals and data signals from various parts. A display 202 displays various menu, document information and image data read by an image reader 207, or the like. A touch panel 203 is of a pressure sensitive type of a transparent material mounted on the display 202. By depressing by fingers or the like the surface thereof, the items or coordinate positions may be input on the display 202.

An FM (frequency modulation) sound source 204 stores music information produced by music editor or the like is stored in a memory 210 or an external memory 212 as digital data. They are read out from the memory and are subjected to FM modulation. The electric signals from the FM sound source 204 is converted to audible sounds by a speaker 205. A printer 206 functions as an output terminal of the wordprocessor function, the personal computer function, the facsimile function and the copying function. The present invention is applied to the printer 206.

An image reader 207 photoelectrically reads an original and is disposed in a path of the original to read various originals for the facsimile function or for the copying function. Facsimile sender and receiver 208 functions to send the original data read by the image reader 207 and to receive the facsimile signals, and functions as a interface with the external. A telephone 209 has the usual telephone function and the message taking function.

Figure 18:
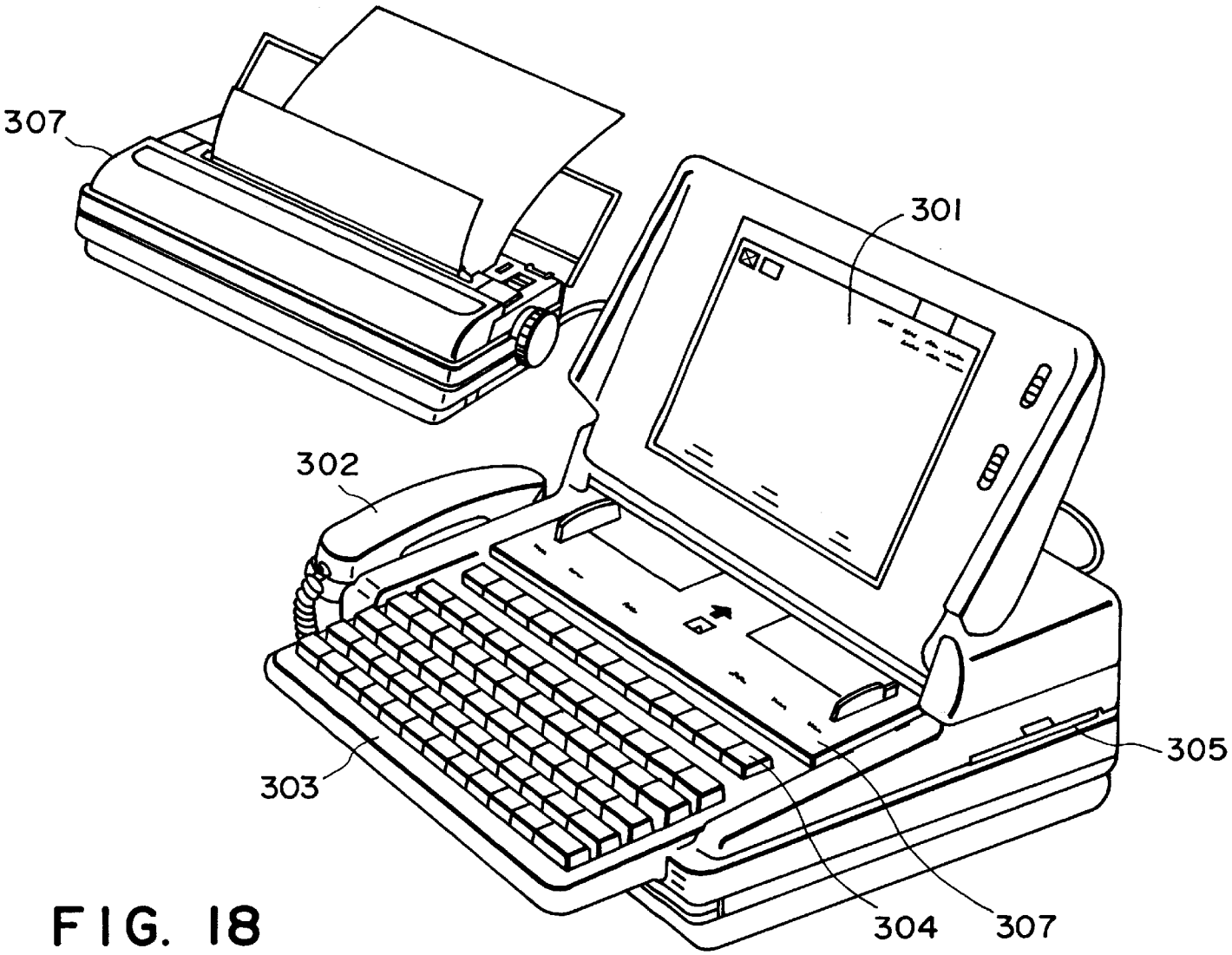
FIG. 18 shows the external appearance of the information processing apparatus of FIG. 17.

Memory 210 comprises a ROM for storing a system program, a managing program, other application programs or the like, a character font, dictionaries or the like, and stores the application program loaded from an external memory 212. It also comprises a video RAM or the like. A keyboard 211 is used for inputting document information or various commands or the like. The external memory 212 is in the form of a floppy disk or a hard disk. In the external memory 212, document information, music, sound information, user's application program or the like are stored. FIGS. 18 is an external view of the information processing apparatus of FIG. 17. A flat panel display 301 is of liquid crystal type and displays various menu and Figure and document information. On the display panel 301, there is a touch panel 203. By depressing the surface of the touch panel 203 by a finger or the like, the items or coordinates may be inputted. A hand set 302 is used when the apparatus functions as a telephone set. The keyboard 303 is detachably connected with the main assembly through a cable, so that various document information and various data can be inputted. The keyboard 303 has various functions keys 304 or the like. The external memory device 212 has an opening 305 for permitting insertion of a floppy disk.

An original supporting platen 307 supports an original to be read by the image reader. The original is discharged to the backside of the apparatus after being read. Upon the facsimile reception or the like, the information is recorded by an ink jet printer 307. The display 202 may be in the form of CRT. However, a ferroelectric liquid crystal display flat panel is desirable, because the size, thickness and the weight may be reduced.

When the information processing apparatus is used as the personal computer or the wordprocessor, the various information inputted on the keyboard 211 is processed by the controller 201 in accordance with a predetermined program, and is outputted as a print by the printer 206.

When it functions as a facsimile machine, the facsimile information supplied from the facsimile sender and receiver 208 through the communication line is processed by the controller 201 in accordance with the predetermined program, and is outputted at the printer 206.

When the apparatus function as the copying machine, the original is read by the image reader 207, and the read data is outputted as the copy through the controller 201 at the printer 206. When it functions as a sender of the facsimile machine, the original data read by the image reader 207 is sent by the controller 201 in accordance with the predetermined program, and thereafter, is supplied to the communication line through the facsimile receiver 208.

Figure 19:
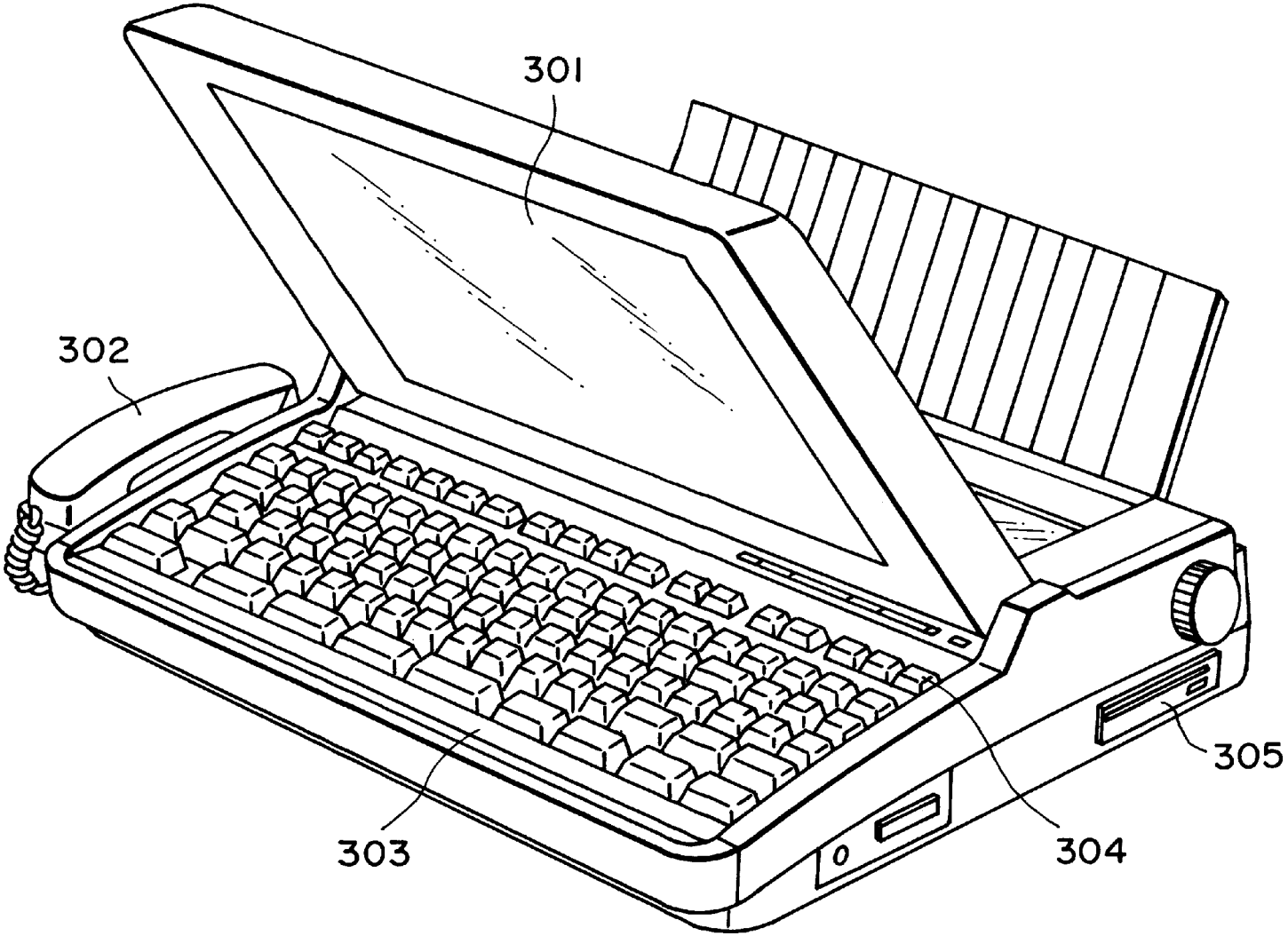
FIG. 19 shows another example of the information processing apparatus.

The information processing apparatus described in the foregoing, may be integral with the main assembly of the ink jet printer, as shown in FIG. 19. In this case, it can be carried around with less difficulty. In this Figure, the same reference numerals as in FIG. 18 are assigned to the elements having the corresponding functions.

When the recording apparatus of the present invention is applied to the multi-function image processing apparatus, high-quality recording can be accomplished, and therefore, the functions of the information processing can be further improved.

While the invention has been described with reference to the structures disclosed herein, it is not confined to the details set forth and this application is intended to cover such modifications or changes as may come within the purposes of the improvements or the scope of the following claims.

What is claimed is:

1. A recording apparatus in which recording is effected using a black ink recording head for ejecting a black ink onto a recording material and a plurality of non-black ink recording heads for ejecting a non-black ink onto the recording material, recording being performed such that a recorded pixel comprises a plurality of dots, comprising:

recording head driving means for driving said black ink recording head and said non-black ink recording head to discharge the inks onto the recording material;

relative movement means for effecting a relative scanning movement between said black ink recording head and the recording material and between said non-black ink recording head and the recording material; and controlling means for controlling said recording head driving means such that during a first said relative scanning movement effected by said relative movement means, recording is effected by scanning, relative to the recording material, said black ink recording head with skipped dots and scanning by said non-black recording heads with skipped dots in a region of the recording material, and during a second said relative scanning movement effected by said relative moving means, recording is effected only by said black ink recording head, for pixels including the dot skipped by said black ink recording head during said first relative movement, by scanning said black ink recording head in such a region of the recording material as was scanned in said first said relative scanning movement.

2. An apparatus according to claim 1, wherein the non-black recording head is provided for each of yellow, magenta and cyan color ink materials.

3. An apparatus according to claim 1, further comprising a selector for setting a datum corresponding to an ink absorbing property of the recording material.

4. An apparatus according to claim 3, wherein said controller effects its controlling operation when the datum representing low ink absorbing property recording material is set in said selector.

5. An apparatus according to claim 1, wherein said recording apparatus comprises the black ink recording head and plural single color non-black recording heads.

6. An apparatus according to claim 1, wherein said volume of the black ink is larger than a total volume, per unit area of the recording material, of the non-black ink and different non-black ink discharged from the non-black ink recording heads and deposited on the recording region of the recording material to provide a mixed color of said non-black ink and said different non-black ink.

7. An apparatus according to claim 1, wherein said recording head discharges the ink by thermal energy and is provided with an electrothermal transducer for producing the thermal energy to be applied to the ink.

8. An apparatus according to claim 7, wherein said recording head discharges the ink through a discharging outlet using a pressure change which is produced by development and contraction of a bubble which is produced by film boiling by the thermal energy applied by the electrothermal transducer.

9. An apparatus according to claim 1, further comprising an original reading means for reading an original to be printed by said apparatus.

10. An apparatus according to claim 1, further comprising information sending and receiving means.

11. An apparatus according to claim 10, further comprising an original reading means for reading an original to be printed by said apparatus.

12. An apparatus according to claim 1, further comprising means for inputting information to be recorded.

13. An apparatus according to claim 12, wherein said input means is in the form of a keyboard.

14. A recording apparatus according to claim 1, wherein said non-black ink recording head is for providing mixed color image.

15. An apparatus according to claim 14, further comprising scanning means for scanning the recording material with the recording head, wherein said control means controls so that a number of scanning operations of the black ink recording head for forming a monochromatic image is larger than the number of scanning operations when the image is formed by said non-black ink recording head.

16. An apparatus according to claim 15, wherein the number of scanning operations of the black ink recording head for forming the monochromatic image is one, and the number of scanning operations when the image is formed by said non-black ink recording head is at least two.

17. An apparatus according to claim 1, wherein during the second relative movement, the black ink recording head eject the ink to dots provided during the first relative movement.

18. An apparatus according to claim 1, wherein during the second relative movement, the black ink recording head eject the ink to portions skipped during the first relative movement.

19. A recording apparatus in which recording is effected using a first recording head for ejecting a black ink onto a recording material to record a character or a line image and a plurality of second recording heads for ejecting a non-black ink onto the recording material to record an image other than the character or the line image, recording being performed such that a recorded pixel comprises a plurality of dots, comprising:

recording head driving means for driving said said black ink recording head and said non-black ink recording head to discharge the inks onto the recording material;

relative movement means for effecting a relative scanning movement between said black ink recording head and the recording material and between said second recording head and the recording material; and control means for controlling said recording head driving means such that during a first said relative scanning movement effected by said relative movement means, recording is effected by scanning, relative to the recording material, said black ink recording head with skipped dots and scanning by said non-black recording heads with skipped dots in a region of the recording material, and during a second said relative scanning movement effected by said relative movement means, recording is effected only by said first recording head, for pixels including the dots skipped by said first recording head during said first relative movement, by scanning said first recording head in such a region of the recording material as was scanned in said first relative scanning movement.

20. A method for recording black and non-black images on a recording material, said method comprising the steps of:

providing a black ink recording head for ejecting a black ink onto the recording material, at least one non-black ink recording head for ejecting a non-black ink onto the recording material, a relative movement means for effecting a first relative scanning movement between said black ink recording head, said non-black ink recording head, and the recording material, and effecting a second relative scanning movement between said black ink recording head and the recording medium;

ejecting the inks from said black ink recording head and said non-black ink recording head during said first relative scanning movement, skipping at least one of the dots in a region of the recording material; and ejecting the ink only from said black ink recording head in said region of the recording material during said second relative scanning movement, in which recording is effected for the skipped dots, by scanning over such a region of the recording material as was scanned in said first scanning movement, in order to fix recorded images onto the recording material and to increase a black image density.

21. A method in which recording is effected using a black ink recording head for ejecting a black ink onto a recording material and at least one non-black ink recording head for ejecting a non-black ink onto the recording material, comprising the steps of:

providing head driving means for driving the recording heads to eject the inks from the recording heads onto the recording material;

providing relative scanning movement means for effecting relative movement between the recording heads and the recording material;

controlling said driving means such that during a first relative scanning movement effected by said relative movement means, the recording is effected by scanning, relative to the recording material, the black ink recording head and the non-black ink recording head with skipped dots over a region of the recording material, and during a second relative movement effected by said relative movement means, the recording is effected, only by said black ink recording head, for skipped dots, by scanning the black ink recording head over such a region of the recording material as was scanned in said first relative scanning movement.

22. A recording method in a recording apparatus having a first recording head for forming a plurality of black dots onto a recording material, a second recording head for forming a plurality of non-black color dots onto the recording material, and scanning means for scanning said first and said second recording heads relative to the recording material, said method comprising:

a first recording step of effecting recording using said first and said second recording heads, based on data which has been skipped in a first predetermined pattern; and a second recording step of effecting recording using only said first recording head, based on data which has been skipped in a second predetermined pattern, said first and said second patterns being such that the dots recorded in said first and said second recording steps are complementary with each other.

* * * * *

UNITED STATES PATENT AND TRADEMARK OFFICE

CERTIFICATE OF CORRECTION

PATENT NO. : 6,102,520
DATED : August 15, 2000
INVENTOR(S) : Koji Terasawa

It is certified that error appears in the above-identified patent and that said Letters Patent is hereby corrected as shown below:

Title page,
Insert: -- [*] Notice: This patent issued on a continued prosecution application filed under 37 CFR 1.53 (d), and is subject to the twenty year patent term provisions of 35 U.S.C. 154 (a) (2). --

Sheet 1 of 13,
Fig. 1, "10h" should read -- 10H --.

Sheet 2 of 13,
Fig. 3, "MACHINISM" should read -- MECHANISM --.

Column 1,
Line 31, "the spreading" should read -- spreading --;
Line 50, "hand when," should read -- hand, when --; and
Line 57, "occurs" should read -- occur --.

Column 2,
Line 21, "an" should read -- a --.

Column 3,
Line 23, "black" should read -- black ink --; and
Line 31, "into" should read -- ink --.

Column 4,
Line 45, "B" should read -- 16B --.

Column 6,
Line 24, "10H when" should read -- 10H. When --;
Line 29, "the numeral," should read -- a numeral, --; and
Line 64, "a" should be deleted.

Column 7,
Line 49, "carried" should read -- is carried --.

Column 9,
Line 2, "dots," should read -- shot dots, --.

Column 11,
Line 2, "head 2A-2D." should read -- heads 2A-2D. --
Line 41, "is," should be deleted.

UNITED STATES PATENT AND TRADEMARK OFFICE

CERTIFICATE OF CORRECTION

PATENT NO. : 6,102,520
DATED : August 15, 2000
INVENTOR(S) : Koji Terasawa

It is certified that error appears in the above-identified patent and that said Letters Patent is hereby corrected as shown below:

Column 12,
Line 4, "alternatively" should read -- alternative --;
Line 14, "major" should read -- characteristic --.

Column 13,
Line 16, "enough" should read -- sufficient --; and
Line 23, "the the" should read -- the --.

Column 14,
Line 24, "is the" should read -- in the --.

Column 15,
Line 3, "is" should read -- are --;
Line 13, "a" should read -- an --;
Line 26, "FIGS. 18" should read -- FIG. 18 --;
Line 58, "function" should read -- functions --; and
Line 66, "foregoing," should read -- foregoing --.

Column 17,
Lines 34 and 38, "eject" should read -- ejects --; and
Line 47, "said said" should read -- said --.

Column 18,
Line 37, "material;" should read -- material; and --.

Signed and Sealed this

Fifth Day of February, 2002

*Attest:*

*Attesting Officer*

JAMES E. ROGAN
*Director of the United States Patent and Trademark Office*